United States Patent [19]

Mattox et al.

[11] Patent Number: 4,569,519

[45] Date of Patent: Feb. 11, 1986

[54] SHOULDER EXERCISING APPARATUS

[75] Inventors: Ernest M. Mattox, Belmont; Andrew J. Van Noord, Grand Rapids, both of Mich.

[73] Assignee: Portable Isokinetics, Inc., Grand Rapids, Mich.

[21] Appl. No.: 599,549

[22] Filed: Apr. 12, 1984

[51] Int. Cl.[4] ..... A63B 21/22

[52] U.S. Cl. ..... 272/131; 272/134; 272/DIG. 4

[58] Field of Search ..... 272/131, 133, 137, 116, 272/136, 134, 142, 135, 144, 117, DIG. 4, 67, 125, 130, 143, 93, 129; 128/25 R

[56] References Cited

U.S. PATENT DOCUMENTS

| | | | |
|---|---|---|---|
| 3,089,700 | 5/1963 | Hotas | 128/25 R X |
| 3,298,688 | 1/1967 | Grzybowski | 272/131 |
| 3,372,928 | 3/1968 | Showalter | 272/125 X |
| 3,768,808 | 10/1973 | Passera | 272/142 X |
| 3,971,255 | 7/1976 | Varney et al. | 272/116 X |
| 3,982,757 | 9/1976 | McDonnell | 272/67 X |
| 4,036,490 | 7/1977 | Rice | 272/131 X |
| 4,249,727 | 2/1981 | Dehan | 272/143 X |
| 4,258,913 | 3/1981 | Brentham | 272/67 |
| 4,344,615 | 8/1982 | Carlson | 272/131 X |

FOREIGN PATENT DOCUMENTS

| | | | |
|---|---|---|---|
| 1153049 | 5/1969 | United Kingdom | 272/67 |

*Primary Examiner*—Richard J. Apley
*Assistant Examiner*—Robert W. Bahr
*Attorney, Agent, or Firm*—Varnum, Riddering, Schmidt & Howlett

[57] ABSTRACT

A shoulder exercising apparatus (100) is adapted for use by a patient to exercise selected muscle/skeletal groups in the shoulder regions. The apparatus (100) includes a rectangular bracket (102) having an adjustably mounted saddle assembly (108). An exercise bar assembly (116) is pivotably coupled to the bracket (102) and includes an elongated outer tube (122) with a power slide (128) having a friction mounting on the tube (122). In use, a patient (136) secures his or her arm within the saddle assembly (108) and moves the power slide (128) along the outer tube (122), thereby exercising various muscles in the shoulder region in accordance with the patient's position relative to the exercising apparatus (100). A force measuring mechanism (124) is coupled to the tube (122) so as to measure external forces exerted in moving the tube (122) relative to a handle rod (138) connected to the bracket (102) and partially received within the tube (122).

6 Claims, 8 Drawing Figures

SHOULDER EXERCISING APPARATUS

Technical Field

The invention relates to exercise apparatus and, more particularly, to portable apparatus for exercising selected shoulder muscle/skeletal groups and for measuring the relative magnitudes of forces exerted during exercise.

BACKGROUND ART

Various types of exercise equipment have been developed throughout history. This equipment is often directed to the exercising and strengthening of various muscle groups, such as the commonly known hand-held squeezing devices for exercising muscles of the hands and lower arms. However, more complex devices have been designed for use in strengthening and exercising other selected muscle groups. Historically, many of these devices used weights, springs or other preset resistances to movement. Such devices required the user to use only that amount of strength necessary to move the device through a weakest part of any movement.

Recently, other devices have been developed which offer resistance at a level adapting automatically to the user's abilities and providing resistance at a level the same or nearly the same as the force applied throughout the entire range of an exercise stroke. Such equipment is typically referred to as "isokinetic" exercising equipment. Many isokinetic exercise devices are relatively complex, expensive and require frequent maintenance. In addition, many of these devices are relatively large and typically require positioning at a stationary fixed location.

Examples of isokinetic exercising equipment are disclosed in the Mattox, U.S. Pat. Nos. 4,249,725 issued Feb. 10, 1981, and 4,385,760 issued May 31, 1983. More recently, a new isokinetic exercise device has the form of a cane which is relatively portable and capable of movement from location to location. This device is particularly advantageous for handicapped individuals.

Although the cane provides substantial advantages over other known exercising equipment, the number and variety of different exercises that can be performed for muscle/skeletal groups in a particular body region is somewhat limited. For example, the variety of exercises available for muscle/skeletal groups in the shoulder region is limited when the user must grip the exercising apparatus with both hands, or when the apparatus does not provide any supporting structure for the user's arm region so as to gain leverage.

One type of known exercise apparatus at least partially overcoming these disadvantages and specifically directed to exercises for shoulder and wrist muscle/skeletal groups employs a bell crank coupled to a sleeve-like slide. The slide is friction mounted to a horizontal stationary tube connected to opposing ends of a supporting structure. Rotation of the bell crank by the user is opposed in an isokinetic manner by the resistance to movement of the slide in an axial direction with respect to the tube.

It is also advantageous in exercising equipment to employ mechanisms for measuring forces exerted by the user during exercise. For example, in the Varney et al U.S. Pat. No. 3,971,255 issued July 27, 1976, an exercise bar includes a sleeve mounted to an elongated tube and slidable with respect to the tube. Bushings within the tube provide a friction slide between the sleeve and the tube, and handles are provided on the sleeve and at one end of the tube. Resistance of the sleeve on the tube is provided through a flat-headed pin and adjustably tensioned spring which exerts forces on the pin. A force measuring device is provided by a coil spring which is positioned between the outer end of the sleeve and an internal bushing. A gauge is mounted on the sleeve and indicates the amount of force applied by the user.

SUMMARY OF THE INVENTION

In accordance with the invention, a portable exercise apparatus for use by a human provides a variety of different exercises for muscle and skeletal groups associated with the shoulder regions. The shoulder exercise apparatus includes a portable structural frame providing a fixed base support while the exercise apparatus is in use. The structural frame includes body-positioning means to position one portion of a user's body. The apparatus also includes an elongated tube having first and second ends, with means mounting the first end of the tube to the structural frame. A slide member is slidably mounted to the tube, and means provide frictional resistance to movement of the slide member along the tube. Body-engaging means on either the slide member or the body-positioning means restrains movement of a user body member with respect to the slide member or the body-positioning means during axial movement of the slide member on the tube. The frame and body-positioning means thereby provide a reactive relationship to the axial movement of the slide member on the tube.

The exercise apparatus also includes force measuring means for visually indicating to the user the relative magnitude of force applied between the slide member and the elongated tube. In addition, the body-engaging means is mounted on the body-positioning means and includes means to selectively connect the body-engaging means to different portions of the frame.

The elongated tube mounting means includes means for pivotably connecting the elongated tube to the frame so that the tube can pivot with respect to the frame as the user moves the slide member relative to the tube. The body-engaging means and the body-positioning means include a saddle mounted to the frame to receive an arm of the user. The elongated tube is mounted to the frame so that the user, with an arm retained in the saddle and a hand gripping the slide member, can move the slide member along the tube by pivoting the arm about the shoulder joint.

The exercise apparatus also includes means received on the tube to adjustably limit the range of axial movement of the slide member on the tube. In addition, the apparatus includes lubrication rings slidably received on the tube to decrease the frictional resistance to axial movement of the slide member along the tube.

The exercise apparatus further includes means received on the tube to prohibit movement of the slide member for strength testing at any position within the range of motion of the user body member. Also included in the apparatus are means to prohibit slide member movement for isometric exercise of the user body member.

BRIEF DESCRIPTION OF THE DRAWINGS

The invention will now be described with reference to the drawings in which.

DETAILED DESCRIPTION

Figure 1:
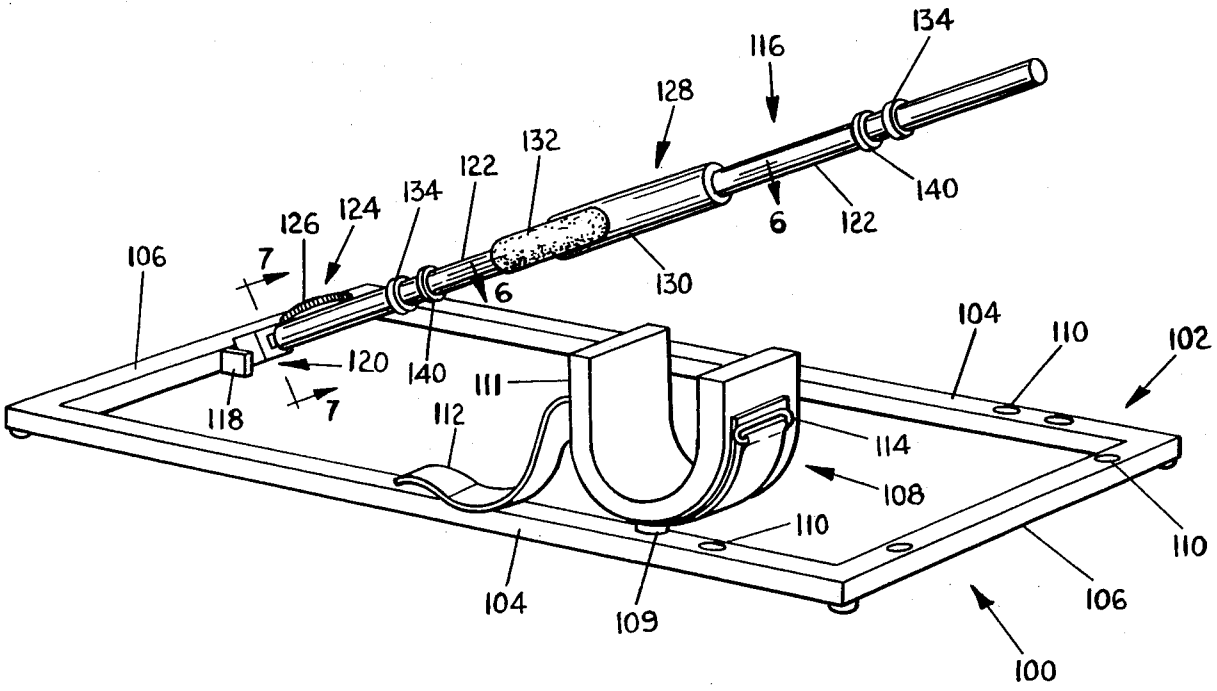
FIG. 1 is a perspective view of a shoulder exercising apparatus in accordance with the invention.
Figure 2:
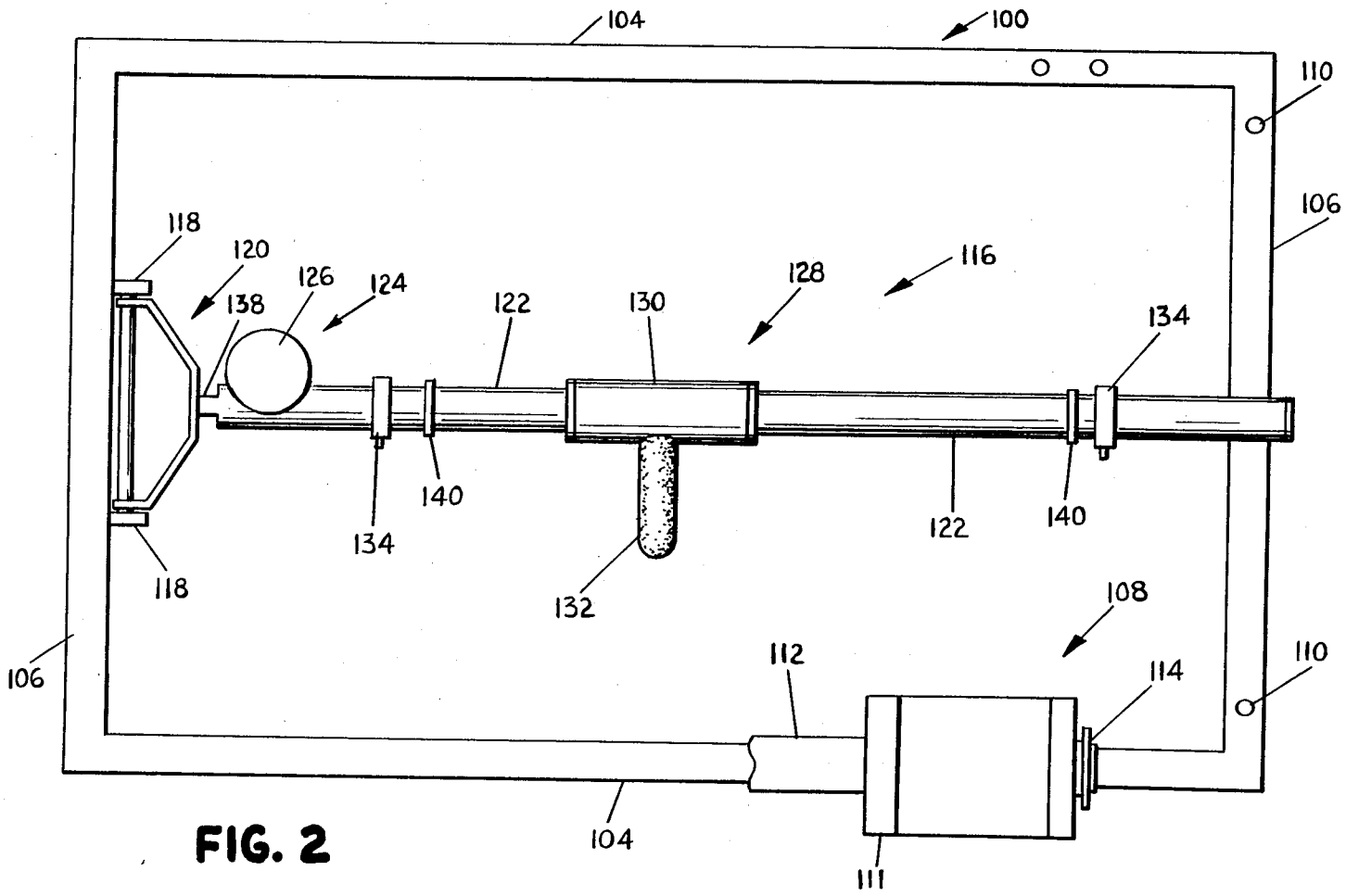
FIG. 2 is a plan view of the shoulder exercising apparatus depicted in FIG. 1.

The principles of the invention are disclosed, by way of example, in a shoulder exercise apparatus 100 as depicted in FIGS. 1 and 2. The exercise apparatus 100 is adapated for use by individuals as a stand-alone unit to exercise various muscles in the shoulder regions. The apparatus 100 is relatively simple in design, lightweight and portable, thereby particularly advantageous for use by handicapped individuals or other patients undergoing rehabilitative exercise therapy. As will be described in detailed herein, the apparatus 100 is adapted to provide resistance to movement during an exercise stroke, thereby requiring strengthening forces to be exerted by the patient.

Referring to FIGS. 1 and 2, the shoulder exercise apparatus 100 includes a rectangular-bracket 102 having a pair of relatively long side members 104 perpendicularly connected at their ends to a relatively shorter pair of side members 106. A saddle assembly 108 having a relatively short stem 109 is adapted to be received in any one of several saddle sockets 110 positioned at various locations around the rectangular bracket 102. The saddle assembly 108 includes a U-shaped saddle 111 having the stem 109 mounted to the outer surface of a bight portion of saddle 111. A flexible locking strap 112 and buckle 114 are also mounted to the outer surface of the saddle 111 and utilized to releasably secure the patient's upper arm.

The shoulder exercise apparatus 100 also includes an exercise bar assembly 116 having an end handle 120. End handle 120 is connected to the rectangular bracket 102 through a clevis assembly comprising a pair of flanges 118 as depicted in FIG. 2. The interconnection of end handle 120 with rectangular bracket 102 provides a pivotable coupling so that the angle of elongated exercise bar assembly 116 can be adjusted relative to the plane of rectangular bracket 102. Any one of several conventional and well-known coupling arrangements can be utilized.

The bar assembly 116 provides a means for exerting resistive forces opposing forces exerted by the user during exercise. Referring to FIGS. 1 and 2, the bar assembly 116 includes an elongated outer tube 122 having a force measurement mechanism 124 comprising a guage dial housing 126. The force measurement mechanism 124 provides a means for visually indicating to the user patient the amount of force being exerted during exercises as subsequently described herein.

Mounted to the elongated outer tube 122 is a power slide 128 comprising a slidable sleeve 130 and slide handle 132 extending radially outward from the sleeve 130. The power slide 128 is received on the elongated outer tube 122 and is friction mounted thereto. That is, the sleeve 130 is slidable along the outer tube 122, but with some degree of force required to generate the sliding movement. The friction mounting can also provide, if desired, a substantially higher frictional resistance to movement of the sleeve 130 in one direction along the axial length of tube 122 than in the opposing direction of relative movement. Ordinarily, a friction mounting arrangement works in an isotropic manner. In addition, the friction mounting can provide for a frictional resistance directly proportional to the linear forces exerted by the user and applied to the sleeve 130 relative to the outer tube 122.

Figure 6:
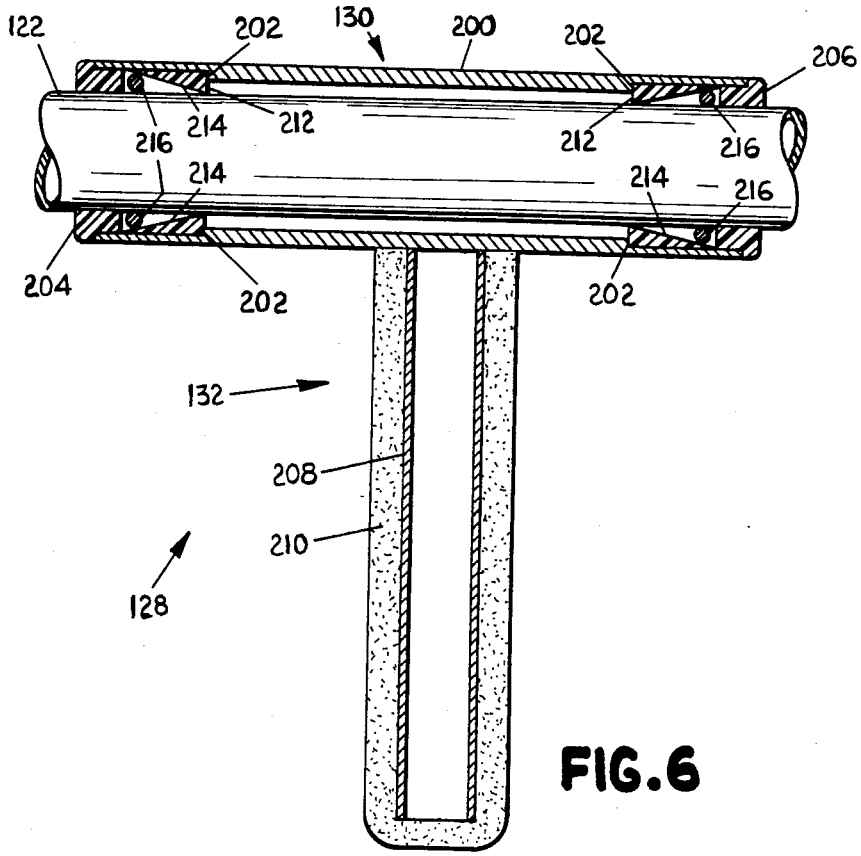
FIG. 6 is a sectional view of the exercise bar mechanism of the shoulder exercising apparatus showing an exemplary friction mounting of the power slide to the elongated tube and taken along lines 6—6 of FIG. 1.

An exemplary friction mounting arrangement comprising several of these features and suitable for use in the shoulder exercising apparatus 100 is depicted in FIG. 6. referring thereto, the sleeve 130 comprises a tubular member 200 which is concentric with the axis of the outer tube 122. The inner diameter of the tubular member 200 is larger than the outer diameter of the tube 122 so that an annular space is provided therebetween. Annular shoulders 202 are found in the inner surface of the tubular member 200. The tubular member 200 is supported on the elongated tube 122 by a pair of annular frictionless bushings 204 and 206. The bushings 204 and 206 are maintained on the tubular member 200 through any suitable connecting means, such as a pair of set screws, staking or adhesive interconnections.

The handle 132 comprises a tubular handle member 208 which is secured to the tubular member 200 by any suitable means, such as a rigid weld. Alternatively, the handle 208 can be releasably secured to the tubular member 200. A rubber covering 210 is bonded to the handle member 208 to provide a firm gripping surface.

A pair of brake mechanisms 212 are mounted within the tubular member 200, adjacent to the frictionless bushings 204 and 206, and in abutting relationship with the corresponding annular shoulders 202. The brake mechanisms 212 each comprise an elongated annular bushing, preferably made of plastic and having an internal ramped or conical surface 214. A pair of annular O-rings 216 are slidably mounted on the elongated tube 122, each fitting within the very end of a corresponding annular brake mechanism 212. The inner diameter of each O-ring 216 is only slightly smaller than the outer diameter of the outer tube 122 so that there is some frictional resistance between each O-ring 216 and the outer tube 122. Any suitable rubber or synthetic rubbery material can be used.

In operation, the user grips the handle 132 and moves the handle, for example, to the right as viewed in FIG. 6. The rubber covering 210 on the handle 132 provides a secure gripping surface. As the handle 132 is moved to the right as viewed in FIG. 6, the frictional resistance between the O-ring 216 on the right and the elongated outer tube 122 causes the right-side O-ring 216 to ride up on the corresponding and adjacent ramp 214, thereby increasing the frictional resistance between the right-side O-ring 216 and the outer tube 122. The extent of movement of the O-ring 216 and the extent of frictional forces between the O-ring 216 and the outer tube 122 depend on the forces applied by the user to the handle 132. In other words, the harder the force, the greater the frictional resistance of the sleeve 130. Thus, the power slide 128 provides a varying kinematic resistance to movement along the outer tube 122, the amount of frictional resistance being dependent on the amount of force applied to the power slide 130 with respect to the outer tube 122.

During movement of sleeve 130 to the right as viewed in FIG. 6, the left-side O-ring 216 will move into abutting relationship with the corresponding bushing 204. In this position of the left-side O-ring 216 with respect to the surface 214 of corresponding brake mechanism 212, little or no frictional resistance is applied by the left-side O-ring 216 on the elongated tube 122. However, movement of the sleeve 130 to the left as viewed in FIG. 6 will cause the left-side O-ring 216 to ride up on ramp surface 214 of the corresponding left-side brake mechanism 212. In the same manner as previously described for movement of sleeve 130 to the right, the amount of frictional resistance between sleeve 130 and tube 122 will be dependent on the amount of force applied to power slide 128 with respect to the outer tube 122.

It should be emphasized that various other types of friction mounting arrangements can be employed with the shoulder exercising apparatus 100. The aforedescribed particular means for mounting the power slide 128 to the elongated outer tube 122 does not form the basis for the principal concepts of the invention described and claimed herein.

Figure 7:
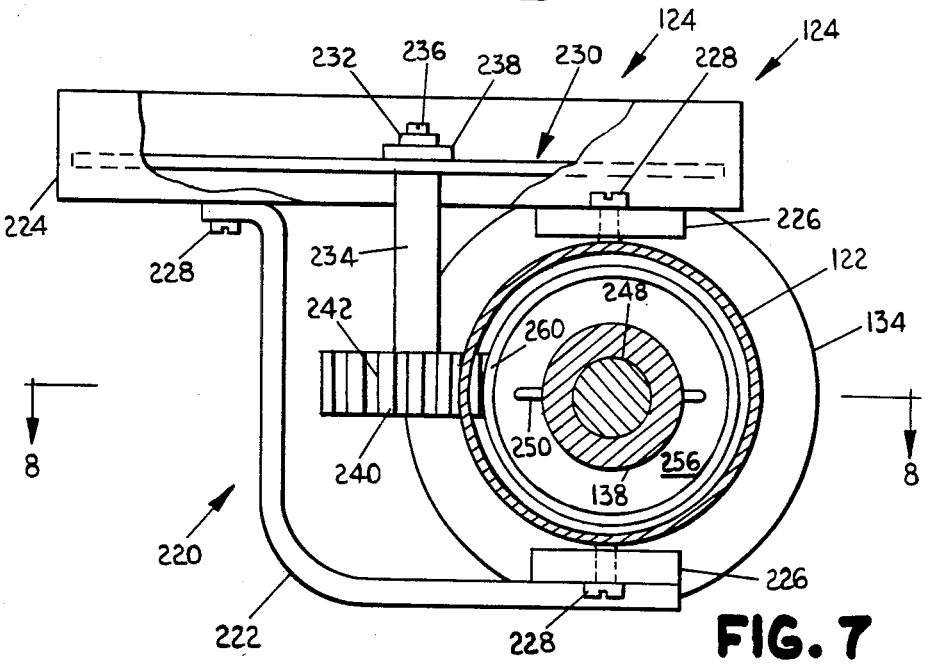
FIG. 7 is a sectional view of the shoulder exercising apparatus showing component parts of the force measuring mechanism and taken along lines 7—7 of FIG. 1.

As previously referenced, a force measuring mechanism 124 is mounted to the elongated outer tube 122 adjacent the end handle 120. Referring to FIGS. 1, 2, 7, and 8, the force measuring mechanism 124 includes a circular gauge 126 rigidly mounted to the outer tube 122 by means of a gauge bracket mounting 220. The bracket mounting 220 includes an angled bracket 222 secured to the bottom of the gauge housing 224 and one of two straight brackets 226 through screws 228. At the upper portion of the elongated tube 122 as depicted in FIG. 7, the gauge housing 224 is directly mounted to the elongated tube 122 by means of screws 228 connected through a second straight bracket 226.

Mounted within the housing 224 and maintained stationary relative thereto is a dial face 230 having spaced apart markings to provide a visual indication of the forces exerted by the user patient during use of the shoulder exercise apparatus 100. Rotatably mounted directly above the dial face 230 is a dial pointer 232. The dial pointer 232 is secured to a gear shaft 234 by means of a screw 236 and stationary washer plate 238. The mounting of the dial pointer 232 above the dial face 230, and the mounting of gear shaft 234 through dial gauge housing 224 and dial face 230, allows the shaft 234 to rotate relative to the dial face 230, thereby correspondingly rotating dial pointer 232 to indicate magnitudes of externally exerted forces as described herein.

Referring specifically to FIG. 7, gear shaft 234 extends downwardly relative to the position of elongated outer tube 122. Rigidly mounted to gear shaft 234 at its lower end is a pinion gear 240 having a series of gear teeth 242. The pinion gear teeth 242 extend into a slot 244 located in the radial surface of outer tube 122.

Figure 8:
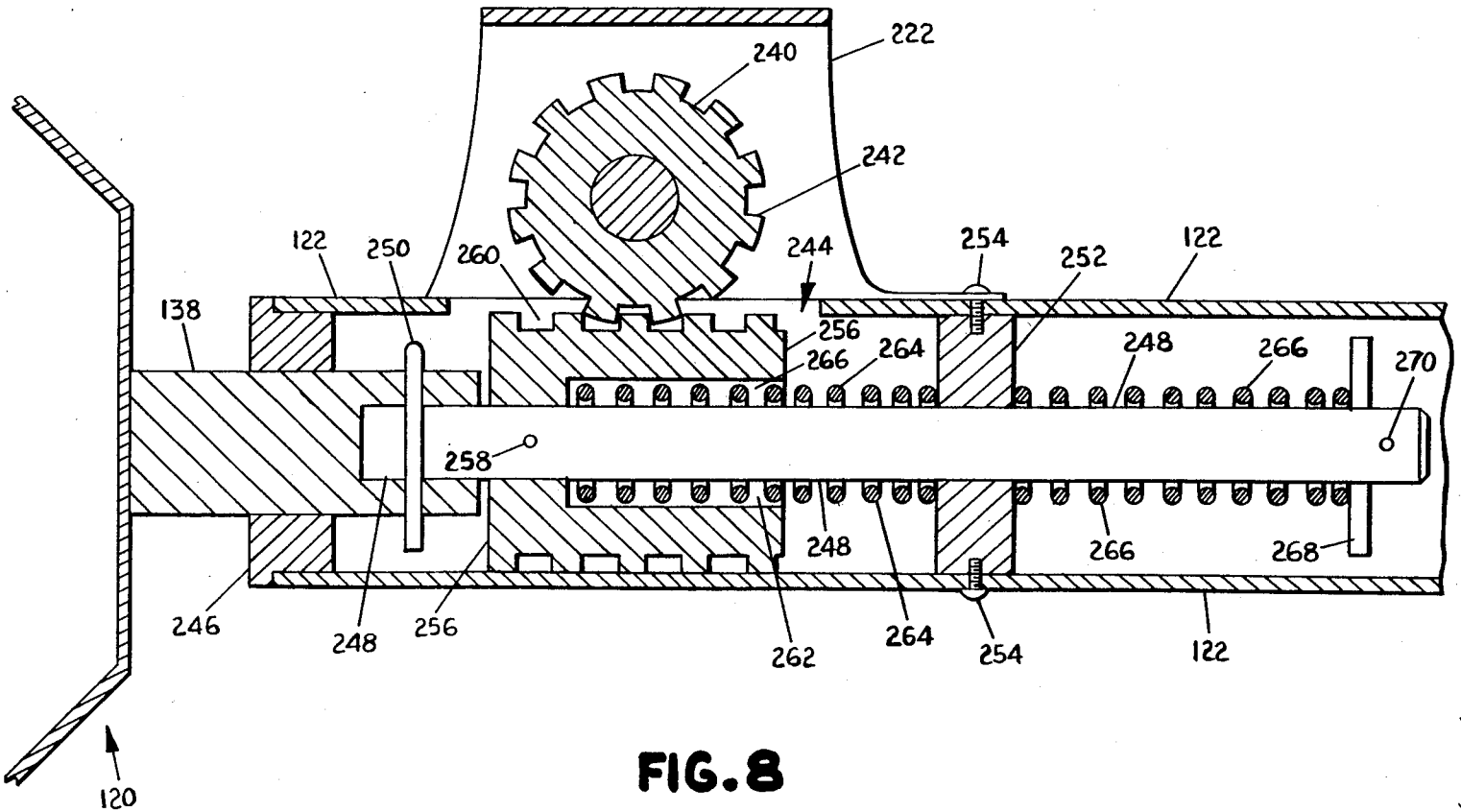
FIG. 8 is a sectional view of the shoulder exercising apparatus showing the force measuring mechanism taken along lines 8—8 of FIG. 7.

Referring particularly to FIG. 8, a stop-and-guide block 246 is mounted in the end of outer tube 122 adjacent the end handle 120. A handle rod 138 extends inwardly from the end handle 120 into the outer tube 122 through the guide block 246. The end of handle rod 138 extending into outer tube 122 includes a recessed area conforming to the shape of a slide rod 248. One end of the slide rod 248 is rigidly secured to the handle rod 138 by means of a cotter pin 250 or other suitable connecting means. The slide rod 248 extends at least partially along the axial length of outer tube 122, is centrally positioned therein, and supported by means of a stationary guide block 252 rigidly secured to the outer tube 122 through screws 254.

Located within the outer tube 122 and intermediate the guide block 252 and the end of slide rod 248 received within handle rod 138 is a spring cup 256 as depicted in FIG. 8. The spring cup 256 includes a cylindrical aperture in which the slide rod 248 is axially received. Slide rod 248 is secured in a stationary position relative to spring cup 256 by means of a pin 258 or similar connecting means.

The spring cup 256 can be substantially cylindrical in shape and includes peripheral rack teeth 260. The rack teeth 260 are positioned within outer tube 122 adjacent the slot 244, and the pinion gear teeth 242 are positioned so as to engage the rack teeth 260.

As also depicted in FIG. 8, the spring cup 256 includes a centrally located slot 262 open at one end and extending partially through the axial length of the spring cup 256. Mounted within the slot 262 and extending outwardly around the slide rod 248 to the guide block 252 is a compression spring 264. Located on the opposing surface of guide block 252 from the compression spring 264 is a second compression spring 266. Compression spring 266 is also positioned around the radial surface of slide rod 248 and supported at opposing ends by the guide block 252 and a washer 268 fixed in a stationary position relative to the slide rod 248 by means of a roll pin 270 or similar securing means In operation, as the power slide 128 moves along the elongated tube 122, the tube 122 will move axially with respect to slide rod 248 in direct proportion to the frictional force between the sleeve 130 and the outer tube 122. Movement of the slide rod 248 relative to the outer tube 122 will result in corresponding movement of the spring cup 256 relative to tube 122. Movement of spring cup 256 relative to tube 122 will cause rotational movement of the pinion gear 240 through engagement of the pinion gear teeth 242 with the rack teeth 260. Rotation of pinion gear 240 will cause corresponding rotation of dial pointer 232 coupled through gear shaft 234 as previously described.

The resistance of the movement of the slide rod 248 with respect to the outer tube 122 is directly proportional to the frictional force of the power slide 128 on the outer tube 122. As the slide rod 248 moves to the right relative to outer tube 122 as viewed in FIG. 8, the compression spring 264 will be increasingly compressed, thereby requiring increasing forces to continue movement of the spring cup 256 and slide rod 248 relative to tube 122. Similarly, as the slide rod 248 is moved to the left as viewed in FIG. 8 relative to outer tube 122, compression spring 266 will be compressed, thereby requiring increasing forces to provide further movement. Thus, the movement of the dial pointer 232 is directly proportional to the frictional force between the sleeve 130 and the outer tube 122.

The shoulder exercise apparatus 100 also includes a pair of adjustable control rings 134 received on the elongated outer tube 122 on opposing sides of the power slide 128. Intermediate each of the control rings 134 and the power slide 128 is a lubrication ring 140. Each of the lubrication rings 140 can be made of leather or similar material, and impregnated with a lubricant. The magnitude of resistance required to move the power slide 128 with respect to the outer tube 122 can be decreased by providing lubrication on the tube 122 by sliding the lubrication rings 140 along tube 122. Similarly, resistance can be increased by removing lubrication from the outer surface of tube 122, and variable resistance can be provided over a particular range of motion by selectively lubricating or removing lubrication from various portions of tube 122. The adjustable control rings 134 provide a means for limiting the range of motion of power slide 128 relative to outer tube 122. In addition, moving the control rings 134 inward so that the motion of power slide 128 is blocked will allow isometric exercise and isometric testing of muscle strength of the user.

Figure 3:
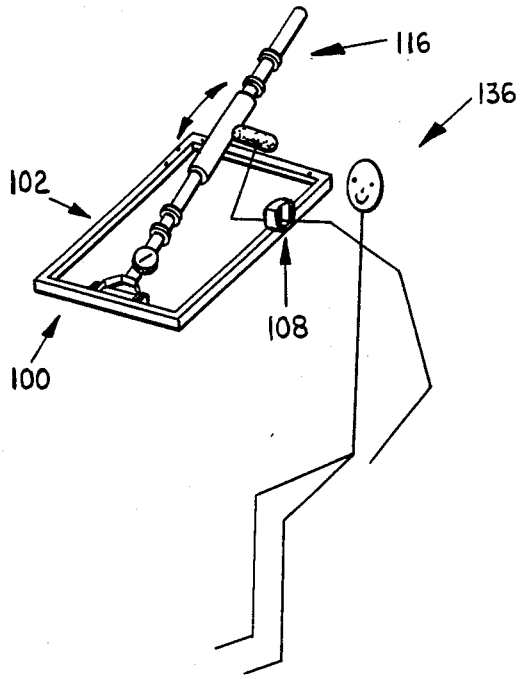
FIG. 3 depicts use of the shoulder exercising apparatus shown in FIG. 1 for shoulder internal and external rotation.

Various exercises for the shoulder muscle/skeletal groups of a patient 136 employing the shoulder exercise unit 100 will now be described with respect to FIGS. 3, 4 and 5. Referring specifically to FIG. 3, an exercise is depicted for shoulder internal and external rotation. The patient 136 maintains a sitting position with his upper arm laterally extended and supported within the saddle assembly 108. The rectangular bracket 102 is maintained in a substantially horizontal plane and the saddle assembly 108 is inserted into a socket 110 so that the relative location of bar assembly 116 to saddle assembly 108 is as shown in FIG. 1.

The elbow of the patient's arm supported within saddle assembly 108 is bent at a substantially 90° angle. The power slide 128 initially positioned relative to outer tube 122 so that the patient's forearm is initially pointed upward when the patient grips the slide handle 132.

With the rectangular bracket 102 maintained in a relatively stationary position, the patient 136 rotates his forearm forward from its initial vertical position, thereby moving the power slide 128 toward the end handle 120. To obtain full rotation, the patient 136 can move his forearm forward and back to the initial vertical position through a 90° range of motion.

Figure 4:
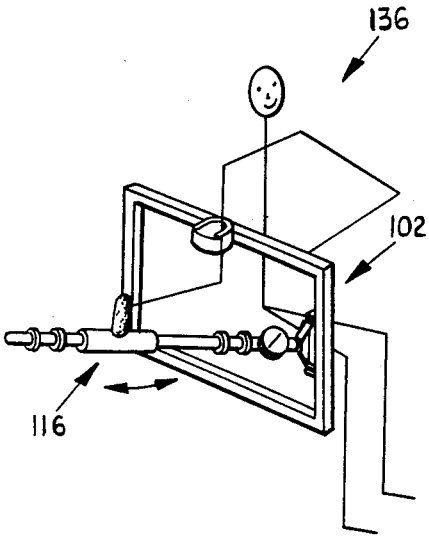
FIG. 4 depicts use of the shoulder exercising apparatus shown in FIG. 1 for shoulder lateral and medial rotation.
Figure 5:
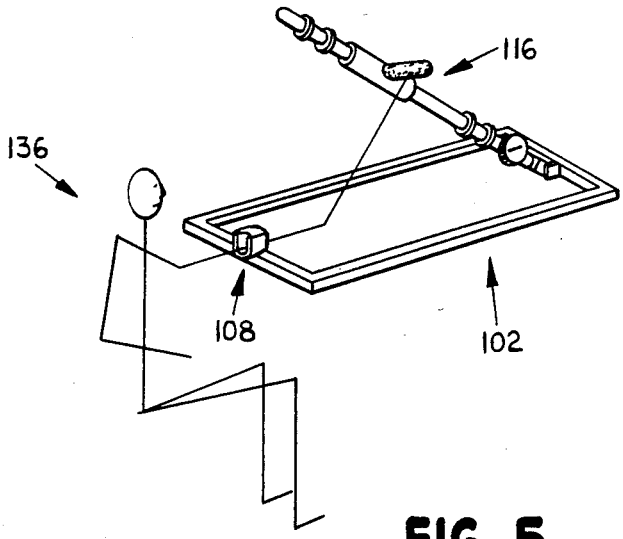
FIG. 5 depicts use of the shoulder exercising apparatus shown in FIG. 1 for elbow flexion and extension.

An exercise to provide lateral and medial rotation of the shoulder muscle/skeletal group using the shoulder exercise apparatus 100 is shown in FIG. 4. For this exercise, the patient 136 maintains a sitting position, with the rectangular bracket 102 positioned in a vertical plane. The patient's upper arm is strapped into the saddle assembly 108, with the assembly 108 located in a socket 110 position so as to be relatively positioned as depicted in FIG. 1. The patient's upper arm is disposed downwardly and the elbow is bent at a substantially 90° angle, with the patient's forearm extending laterally from the patient's side. With the patient gripping the power slide 128 in the manner shown in FIG. 4, the forearm is rotated forward, thereby moving the power slide 128 toward the end handle 120. To obtain full lateral and medial rotation, the forearm should be rotated forward and backward through a 90° range of motion.

The shoulder exercise apparatus 100 can also be utilized to provide an exercise for elbow flexion and extension. Referring to FIG. 5, the patient 136 maintains a sitting position with the shoulder exercise apparatus 100 in a substantially horizontal plane directly in front of the patient 136. Again, the patient 90 secures his upper arm in saddle assembly 108, with the upper arm also in a horizontal plane. It should be noted that this particular exercise requires the saddle assembly 108 to be moved to a saddle socket 110 located in the relatively short side member 106 opposing the side member 106 to which bar assembly 116 is mounted. The patient 136 then grips the power slide 128 with the fingers of his hand pointed either upwardly or downwardly. The upper arm is maintained substantially stationary and the power slide 128 is moved along the outer tube 122, thereby alternately bending and straightening the patient's elbow. To provide full elbow flexion and extension, the power slide 128 should be moved so that the angle of the patient's forearm relative to a horizontal plane ranges from 0° to 160°.

The shoulder exercise apparatus 100 can be adapted to provide a variety of other types of exercises, depending upon the particular rehabilitative needs of the patient. Furthermore, the principles of the invention are not limited to the specific shoulder exercise apparatus 100 described herein. For example, the positioning of the force measuring mechanism 124 can be moved to various locations relative to the ends of the elongated tube 122. It will be apparent to those skilled in the art that modifications and other variations of the above-described illustrative embodiments of the invention may be effected without departing from the spirit and scope of the novel concepts of the invention.

The embodiments of the invention in which an exclusive property or privilege is claimed are defined as follows:

1. A shoulder exercise apparatus comprising:

a portable structural frame providing a fixed base support while the exercise apparatus is in use;

an elongated tube having first and second ends;

a slide member slidably mounted to the elongated tube;

means providing frictional resistance to movement of said slide member along said elongated tube;

body-positioning means selectively mountable to different portions of said frame for positioning a user's upper arm and restraining movement of said upper arm along the longitudinal axis of said upper arm with respect to said slide member during axial movement of said slide member on said tube;

means for pivotably connecting said first end of said elongated tube to said frame so that said elongated tube can pivot with respect to said frame as said user grips said slide member and moves said slide member along said tube, and further so that the distance between said body-positioning means and said slide member for any given axial position of said slide member along said tube can be varied to accomodate differing arm lengths of various users;

whereby said frame and body-positioning means provide a reactive relationship to axial movement of said slide member on said elongated tube;

force-measuring means for visually indicating to the user the relative magnitude of force applied between the slide member and the elongated tube; and said body-positioning means being mountable to at least one portion of said frame so that said user, with said upper arm restrained in said body-positioning means and a hand gripping said slide member, can achieve elbow flexion and extension exercises by moving said slide member along said tube.

2. A shoulder exercise apparatus according to claim 1 wherein said body-positioning means comprises a saddle mounted to said frame to receive an upper arm of the user; and the elongated tube being so mounted to the frame that the user with an arm retained in the saddle and a hand gripping the slide member can move the slide member along the elongated tube by pivoting the arm about the shoulder joint.

3. A shoulder exercise apparatus in accordance with claim 1 and further comprising means received on said tube for adjustably limiting the range of axial movement of said slide member on said tube.

4. A shoulder exercise apparatus in accordance with claim 1 and further comprising lubrication rings slidably received on said tube for decreasing the frictional resistance to axial movement of said slide member along said tube.

5. A shoulder exercise apparatus in accordance with claim 1 and further comprising means received on said tube for prohibiting movement of said slide member for strength testing in any position within the range of motion of said user's arm.

6. A shoulder exercise apparatus in accordance with claim 1 and further comprising means recieved on said tube for prohibitng movement of said slide member for isometric exercise at any position within the range of motion of said user's arm.

* * * * *